US008951644B2

(12) United States Patent
Burns et al.

(10) Patent No.: US 8,951,644 B2
(45) Date of Patent: Feb. 10, 2015

(54) THERMALLY PROTECTIVE MULTIPHASE PRECIPITANT COATING

(75) Inventors: Andrew J. Burns, Orlando, FL (US); Anand A. Kulkarni, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1811 days.

(21) Appl. No.: 11/950,791

(22) Filed: Dec. 5, 2007

(65) Prior Publication Data

US 2013/0230739 A1 Sep. 5, 2013

Related U.S. Application Data

(60) Provisional application No. 60/973,560, filed on Sep. 19, 2007, provisional application No. 60/974,558, filed on Sep. 24, 2007, provisional application No. 60/974,561, filed on Sep. 24, 2007, provisional application No. 60/974,564, filed on Sep. 24, 2007.

(51) Int. Cl.

| | |
|---|---|
| ***B32B 15/04*** | (2006.01) |
| ***B32B 15/20*** | (2006.01) |
| ***C23C 28/00*** | (2006.01) |
| ***C23C 30/00*** | (2006.01) |

(Continued)

(52) U.S. Cl.

CPC ..... *F01D 25/005* (2013.01); *C23C 28/325* (2013.01); *C23C 28/3455* (2013.01); *C23C 28/3215* (2013.01); *C23C 30/00* (2013.01); *C23C 28/345* (2013.01)

USPC ..... 428/680; 428/632; 428/633; 428/668; 428/678; 416/241 R

(58) Field of Classification Search

CPC .... B32B 15/01; B32B 15/016; B32B 15/017; B32B 15/04; B32B 15/043; B32B 15/20; B32B 2311/22; B32B 2311/24; B32B 2603/00; C23C 28/00; C23C 28/021; C23C 28/022; C23C 28/028; C23C 28/3215; C23C 30/00; C23C 30/005; C23C 4/085

USPC ..... 428/623, 627, 630, 631, 632, 633, 668, 428/678, 680

See application file for complete search history.

(56) References Cited

U.S. PATENT DOCUMENTS 4,485,151 A 11/1984 Stecura
4,503,130 A * 3/1985 Bosshart et al. ..... 428/632

(Continued)

FOREIGN PATENT DOCUMENTS

DE 3842301 * 6/1990
WO WO 99/49100 * 9/1999

OTHER PUBLICATIONS

Machine Translation, Singheiser Lorenz, DE 3842301, Jun. 1990.*

(Continued)

*Primary Examiner* — Michael E La Villa

(57) ABSTRACT

A thermally protective coating (21), such as may be used over a nickel-based superalloy substrate (24). The protective coating (21) includes a CoNiCrAlY or a NiCoCrAlY material and addition of given amounts of one or more secondary elements. The secondary element(s) facilitate and/or join in one or more precipitation mechanisms (γ', B2) that retain an aluminum reservoir in the protective coating (21), reducing aluminum diffusion into the substrate (24). This aluminum reservoir maintains a protective alumina scale (38) on the coating (21), thus improving coating life and allowing higher operating temperatures.

5 Claims, 4 Drawing Sheets

(51) Int. Cl.
*F01D 5/28* (2006.01)
*F01D 25/00* (2006.01)

(56) References Cited

U.S. PATENT DOCUMENTS

| | | | | |
|---|---|---|---|---|
| 4,615,864 | A | 10/1986 | Dardi et al. | |
| 6,168,874 | B1 | 1/2001 | Gupta et al. | |
| 6,207,297 | B1 | 3/2001 | Sabol et al. | |
| 6,296,447 | B1 | 10/2001 | Rigney et al. | |
| 6,376,015 | B1 | 4/2002 | Rickerby | |
| 6,440,496 | B1 | 8/2002 | Gupta et al. | |
| 6,555,179 | B1 | 4/2003 | Reeves et al. | |
| 6,610,419 | B1 | 8/2003 | Stamm | |
| 6,677,064 | B1 | 1/2004 | Subramanian | |
| 6,896,488 | B2 | 5/2005 | Bruce et al. | |
| 6,924,046 | B2 | 8/2005 | Stamm | |
| 7,150,921 | B2 | 12/2006 | Nelson et al. | |
| 7,198,462 | B2 | 4/2007 | Merrill et al. | |
| 7,244,467 | B2 | 7/2007 | Grossman et al. | |
| 7,250,222 | B2 | 7/2007 | Halberstadt et al. | |
| 8,039,117 | B2 * | 10/2011 | Kulkarni et al. | 428/632 |
| 8,043,717 | B2 * | 10/2011 | Kulkarni et al. | 428/632 |
| 2002/0132132 | A1 | 9/2002 | Bose et al. | |
| 2003/0054108 | A1 | 3/2003 | Beele | |
| 2005/0287296 | A1 | 12/2005 | Wadley et al. | |
| 2007/0116980 | A1 | 5/2007 | Schmitz et al. | |
| 2008/0032105 | A1 * | 2/2008 | Taylor | 428/215 |
| 2008/0163785 | A1 * | 7/2008 | Hardwicke et al. | 106/1.21 |

OTHER PUBLICATIONS

A.M. Smyslov, A.A. Bybib, R.R. Nev'Yantseva; "Effect of ion implantation and plasma surface treatment on exploitation properties of heat-resistant Ni alloy"; Database CA [online] Chemical Abstracts Service, Columbus, Ohio US 2007; Retrieved from STN Database accession No. 148:384059 abstract.

Keith E. Knipling, David C. Dunand, David N. Seidman; "Criteria for developing castable, creep-resistant aluminum-based alloys—A review"; Magazine for Metallurgy, Mar. 2006; vol. 97, No. 3; XP001244723; ISSN: 0044-3093; Munich Germany.

* cited by examiner

THERMALLY PROTECTIVE MULTIPHASE PRECIPITANT COATING

CROSS REFERENCE TO RELATED APPLICATIONS

This application claims the benefit of four U.S. provisional patent applications: 60/973,560, filed Sep. 19, 2007; 60/974,558, filed Sep. 24, 2007; 60/974,561, filed Sep. 24, 2007; and 60/974,564, filed Sep. 24, 2007. These provisional applications are incorporated by reference herein in their entirety.

FIELD OF THE INVENTION

The invention relates generally to thermally protective coatings for metal structures.

BACKGROUND OF THE INVENTION

Gas turbine components are subjected to rigorous mechanical loading, thermal stress, oxidation, corrosion, and abrasion. Hot gas path components of such turbines are often made of nickel or cobalt based superalloys optimized for resistance to high temperature creep and thermal fatigue. Protective coatings are applied to increase durability and field performance at high temperatures. MCrAlY (where M represents a transition metal, and Y represents yttrium) is a material commonly used as a protective coating, especially as a bond coat for an overlying ceramic insulation as part of a thermal barrier coating (TBC) system. Such bond coats prevent the substrate from being deteriorated by oxygen, and they act as an intermediary to bridge the difference in the coefficients of thermal expansion (CTE) between the ceramic and metallic materials, thereby reducing stress levels.

MCrAlY materials have been optimized for thermal and chemical compatibility with the superalloys along with oxidation and corrosion resistance. In gas turbine components, the M in MCrAlY is normally nickel (Ni) and/or cobalt (Co). Nickel-based alloys provide superior oxidation resistance, and cobalt-based alloys provide superior corrosion resistance. The chromium (Cr) provides hot corrosion resistance, and aluminum (Al) aids in formation of a stable oxide barrier. Yttrium (Y) enhances adherence of the oxide layer. Elemental additions of cerium, silicon, lanthanum or hafnium to the bond coats are done to improve their performance in terms of the oxidation or thermo-mechanical behavior and ceramic coating adherence. Performance of a TBC often depends on the ability of the underlying MCrAlY bond coating to form a tenacious, protective, aluminum oxide scale that is thermodynamically stable, slow growing, adherent, and that inhibits interactions between the substrate surface and the outside corrosive environment.

BRIEF DESCRIPTION OF THE DRAWINGS

The invention is explained in the following description in view of the drawings that show.

DETAILED DESCRIPTION OF THE INVENTION

Figure 1:
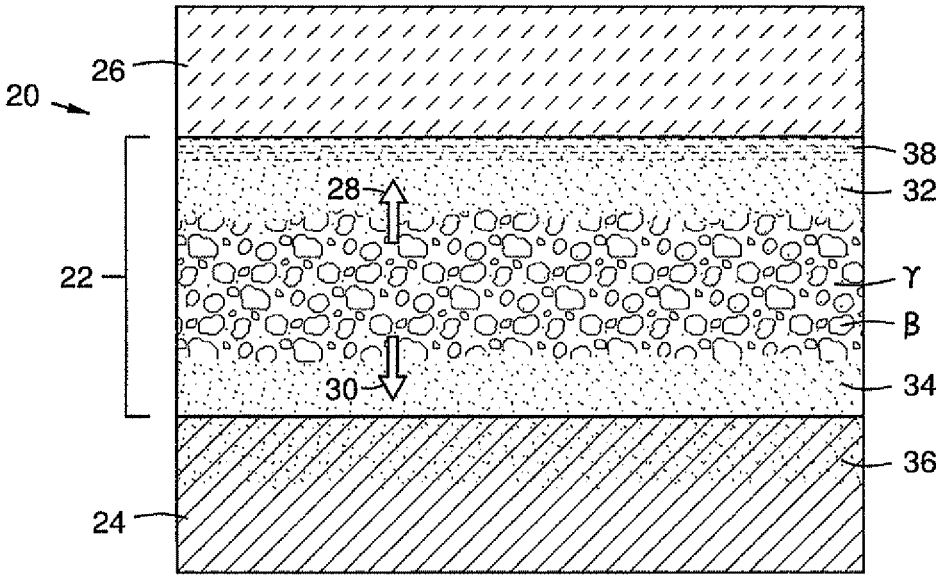
FIG 1 PRIOR ART
FIG. 1 is a prior art sectional view of a metal substrate with a bond coat and a thermal barrier coating, illustrating diffusion of aluminum and depletion of a beta phase β from the bond coat.

FIG. 1 shows a known thermal barrier coating system 20 including a bond coat 22 of MCrAlY (such as CoNiCrAlY) adherent to a nickel-based superalloy substrate 24, and a ceramic insulation thermal barrier coating (TBC) 26 adherent to the bond coat. Typically, such a bond coat 22 includes a two-phase region, beta (β) plus gamma (γ), in which a matrix γ carries an aluminum rich beta phase β. In one example, an aluminum rich nickel aluminide phase (beta β or NiAl) is carried within a cobalt, nickel, and chromium rich matrix phase (gamma γ). The matrix γ increases the ductility of the coating, thereby improving thermal fatigue resistance. At high temperatures, diffusion interactions 28, 30 result in depletion of the aluminum, due to formation of an aluminum oxide layer 38 on the top of the bond coat. As the concentration of aluminum decreases, the β phase tends to dissolve. For this reason, the β phase may be described as an aluminum reservoir, and the coating life may be measured in terms of depletion of β. Diffusion interactions of this system in an oxidizing environment form outer and inner β depletion zones 32, 34 as a function of time and temperature. Within the substrate 24 a diffusion zone 36 forms which is termed the interdiffusion zone.

A thermally grown oxide (TGO) layer 38 such as aluminum oxide forms on the outer surface of the bond coat 22 due to exposure of the layer to oxygen at high temperatures. In a TBC system comprising a superalloy substrate, a bond coat, and a ceramic topcoat, this oxide layer, which forms between the ceramic insulation 26 and the bond coat 22, provides insulation from further oxidation, corrosion, and heat. The TGO layer 38 grows during high temperature operation by diffusion 28 of aluminum to the outer surface of the bond coat 22 in the presence of oxygen diffused through the TBC layer 26.

The formation of the outer β depletion zone 32 is primarily driven by the formation of the oxide layer 38 at the outer surface of the bond coat 22. This depletes the concentration of aluminum in the metal adjacent to the oxide. Thus, outer β depletion is proportional to the growth of the oxide scale. The inner β depletion 30 is a function of β-phase instability in the presence of changing matrix γ-phase compositions in the bond coat 22 caused by substrate/coating interdiffusion. For some superalloy compositions, the inward loss 30 of the β phase to the substrate 24 is more rapid at a given temperature than is the outward loss 28 of the β phase to the TGO 38. Since aluminum lost through inner β phase depletion is not utilized for TGO 38 growth, it is essentially wasted for the function it was applied to perform, i.e. availability for maintenance of the passive oxide scale 38. The present inventors have appreciated that any amount of inner β depletion contributes to a debit from the ideal coating oxidation resistance. Thus, it is proposed herein to control aluminum diffusion in the bond coat—particularly the inward diffusion of aluminum atoms into the substrate 24.

One way to reduce aluminum diffusion is to delay diffusion within the bond coat 22 itself, and/or slow its migration. This can be achieved by certain elemental additions to an MCrAlY bond coat material that modify the beta phase structure, or which catalyze and/or recombine with the diffusing aluminum to precipitate secondary aluminum-rich phases γ' (with about 6 wt % Aluminum (Al)) and B2 (with about 7 wt % Aluminum (Al)) within the bond coat. These secondary phases recapture the aluminum temporarily, thus slowing its migration.

The new element(s) combine with diffusing elements in such a way as to promote and stabilize new aluminum rich phases in the region of the original coating/substrate interface. Thus, inner β-phase dissolution 30 is delayed, leading to prolonged life of the coating system. Creating one or more stable second aluminum-rich phases γ', B2 requires addition of one or more element(s) that combine with the escaping aluminum in a diffusion interaction to form solid precipitant phases. The additional elements may be selected from strontium (Sr), ruthenium (Ru), lanthanum (La), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), tantalum (Ta), rhenium (Re), and combinations thereof. The γ' phase is typically NiAl3 and the B2 phase is typically complex precipitates (Aluminides of nickel, cobalt, chromium and one of the additional elements from above). These elements are called "seed elements" herein, and an MCrAlY layer modified with them in prescribed amounts is called a "seed layer". Some examples of these additions are tabulated below, showing their mechanisms of improvement. Certain combinations of such additions have special synergies, as tabulated below. A seed layer 21 will maintain a high aluminum concentration or reservoir in and above the original coating/substrate interface in the form of metal precipitants.

| | COMPOSITION | MECHANISM |
|---|---|---|
| 1. | CoNiCrAlY or NiCoAlY with 1-4 wt % praseodymium | Forms B2 phase (can be Al rich PrAl2 or a complex aluminide of Pr/Ni/Co/Cr) and NiAl3 phase |
| 2. | CoNiCrAlY or NiCoAlY with 1-4 wt % samarium | Forms B2 phase (can be Al rich SmAl2 or a complex aluminide of Sm/Ni/Co/Cr) and NiAl3 phase |
| 3. | CoNiCrAlY or NiCoAlY with 1-4 wt % neodymium | Forms B2 phase (can be Al rich NdAl2 or a complex aluminide of Nd/Ni/Co/Cr) and NiAl3 phase |
| 4. | CoNiCrAlY or NiCoAlY with 1-4 wt % neodymium and 0.2-1.0 wt % ruthenium | Forms combinations of Al rich NdAl2, NiAl3, and RuAl phases |
| 5. | CoNiCrAlY or NiCoAlY with 2-5 wt % tantalum and 1-3 wt % lanthanum | Forms TaAl3 and refines the beta precipitant size |

Compositions 1-3 above are examples of a seed layer embodiment with additions of 1-4 wt % of one or more lanthanides, especially praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu), and combinations thereof. Composition 5 above reduces the average beta precipitant microstructure size by reducing the percentage of precipitants in the 7-10 micron range, and increasing their percentage in the 1-7 micron range. This has been found to slow aluminum diffusion. While this finer particle size provides higher surface area for oxidation, it also provides increased precipitant recombination opportunities.

Figure 2:
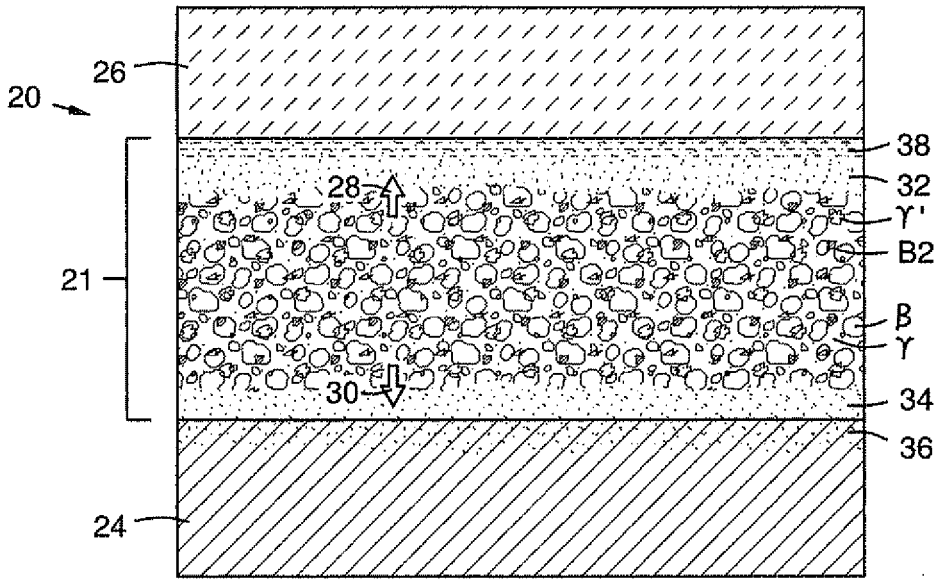
FIG. 2 is a sectional view of a metal substrate with a bond coat that traps diffusing aluminum within one or more secondary phases, providing an aluminum reservoir that delays aluminum depletion according to an aspect of the invention.

FIG. 2 shows an aspect of the invention in which an MCrAlY bond coat layer 21 is modified with one or more seed elements, forming a seed layer that delays the aluminum migration as described above. One or more secondary aluminum-rich phases γ', B2 are formed within the seed layer 21 by mechanisms such as listed above.

Another way to reduce aluminum diffusion into the substrate is to apply an MCrAlY seed layer 21 modified with seed elements, and then apply a second layer 22 on the seed layer. The second layer may be a conventional MCrAlY bond coat 22, or it may be another seed layer composed according to the invention. In either case, aluminum that would diffuse from the second layer 22 into the substrate 24 is delayed and reserved in the first seed layer 21 by one or more of the mechanisms listed above.

Figure 3A:
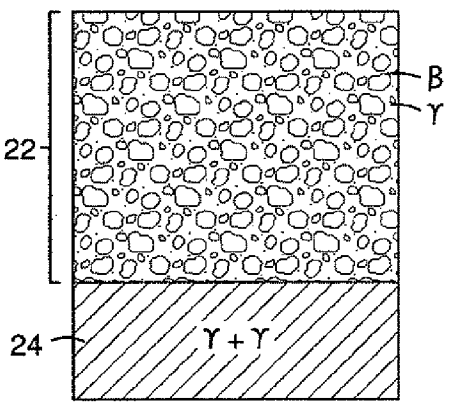
FIG 3A PRIOR ART
FIG. 3A illustrates a prior art MCrAlY coating on a superalloy substrate.
Figure 3B:
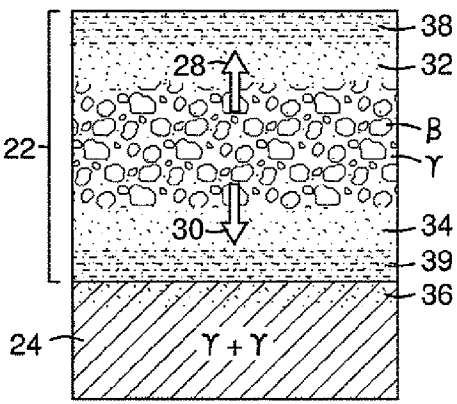
FIG 3B PRIOR ART
FIG. 3B illustrates the coating of FIG. 3A during high temperature operation.
Figure 3C:
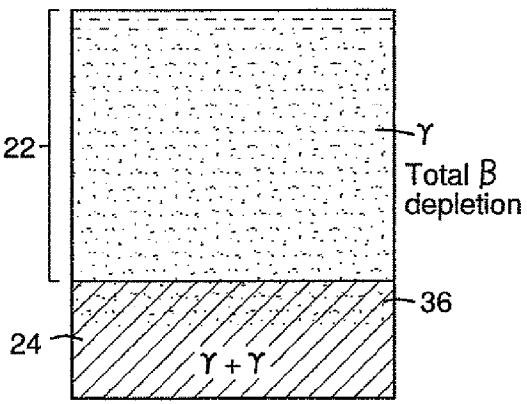
FIG 3C PRIOR ART
FIG. 3C illustrates the coating of FIG. 3A after total β-phase depletion, marking the end the coating lifespan.

FIGS. 3A-3C show stages in the lifespan of a conventional MCrAlY bond coat 22 on a superalloy substrate 24. A ceramic insulation outer coating is not shown in order to focus on the bond coat. FIG. 3A shows the bond coat 22 prior to use. FIG. 3B shows β phase depletion 28, 30 in progress during high temperature operation, producing outer and inner oxidation zones 38, 39. FIG. 3C shows the bond coat 22 at the end of its lifespan due to total β depletion.

Figure 4A:
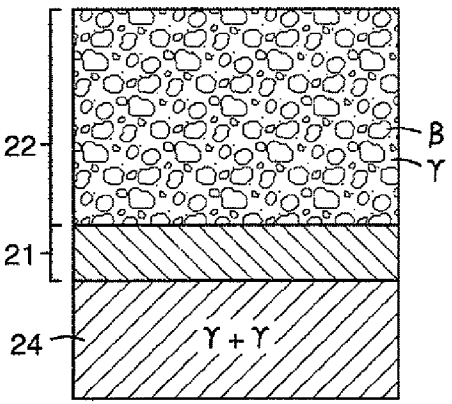
FIG. 4A illustrates an MCrAlY coating having first and second layers on a superalloy substrate according to an aspect of the invention.
Figure 4B:
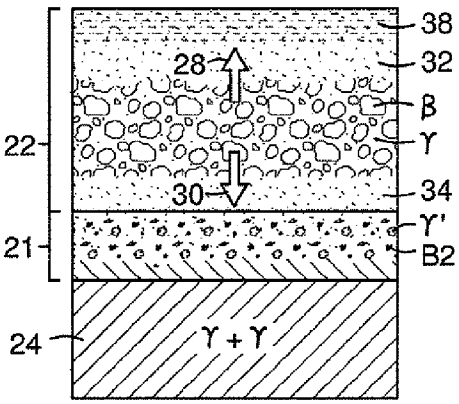
FIG. 4B illustrates the coating of FIG. 4A during high temperature operation illustrating how the first layer traps escaping aluminum in one or more secondary phases, thereby delaying depletion.
Figure 4C:
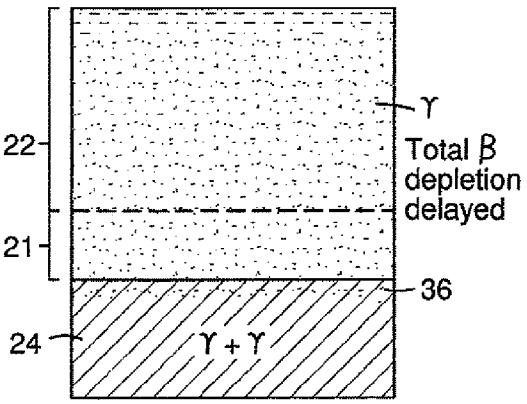
FIG. 4C illustrates the coating of FIG. 4A after total β-phase depletion, marking the end the coating lifespan.

FIGS. 4A-4C show stages in the lifespan of first and second layers 21, 22 on a superalloy substrate 24, where the first layer 21 is a seed layer modified according to the invention, and the second layer 22 is a conventional MCrAlY bond coat. A ceramic outer coating may be used, but is not shown in order to focus on the layers 21, 22. FIG. 4A shows the layers prior to use. FIG. 4B shows β-phase depletion 28, 30 in progress in the second layer 22 during high temperature operation. Inwardly diffusing aluminum 30 precipitates into one or more secondary phases γ', B2 in the seed layer 21. This mechanism forms an aluminum reservoir and reduces the concentration of free aluminum atoms at the surface of the substrate 24. Thus, the seed layer 21 reduces the amount of aluminum that is available to diffuse across the coating/substrate boundary, because a portion of the free aluminum is retained in the reservoir created by the secondary phases. A free aluminum concentration gradient is thereby created across the seed layer 21, with a lowered concentration of free aluminum being available for diffusion at the substrate surface. FIG. 4C shows the layers 21, 22 at the end of their lifespan due to total β, γ', and B2 depletion. The lifespan of FIG. 4C is longer than that of FIG. 3C with equivalent operating conditions, layer 22 compositions, and total thickness.

The first layer 21 may have chemistry similar to that of the second layer 22, but may incorporate one or more of the above seed elements not found in the second layer. Thus, the first and second layers 21, 22 may be considered distinct for discussion and illustration purposes. In practice, the first layer 21 may be a subset of the overall thickness of the second layer 22 wherein specific elements have been added and are available for the formation of secondary metal precipitants desired as an aluminum reservoir. One or more seed elements may be added throughout a seed layer or only to a region of the coating that is remote from a surface where it is desired to form a protective alumina layer 38. For example, an MCrAlY layer with seed elements concentrated adjacent the substrate may be achieved by means of layered deposition using atmospheric/low pressure/vacuum plasma or high velocity oxy-fuel spraying. The first layer thickness may be 50-200 micrometers, with a preferred range of 75-125 micrometers. In a two-layer system, the combined thickness of the two layers may be in the range of 125 to 325 micrometers.

Multiple layers with the new elemental additions may be used. The presence of multiple seed layers forms multiple precipitated aluminum phases as diffusion progresses. When multiple seed layers are used, they may have the same or different compositions from each other.

MCrAlY bond coat compositions can be modified to improve oxidation and corrosion resistance and thermo-mechanical properties by additional alloying elements or by an oxide dispersion in the matrix. Additions of hafnium (Hf), platinum (Pt), titanium (Ti), tungsten (W), and/or tantalum (Ta) offer oxidation resistance. Addition of rhenium (Re) improves isothermal or cyclic oxidation resistance and thermal cycle fatigue. One or more of these elements may be incorporated in a first and/or second layer of the present invention to provide these improvements.

Figure 5:
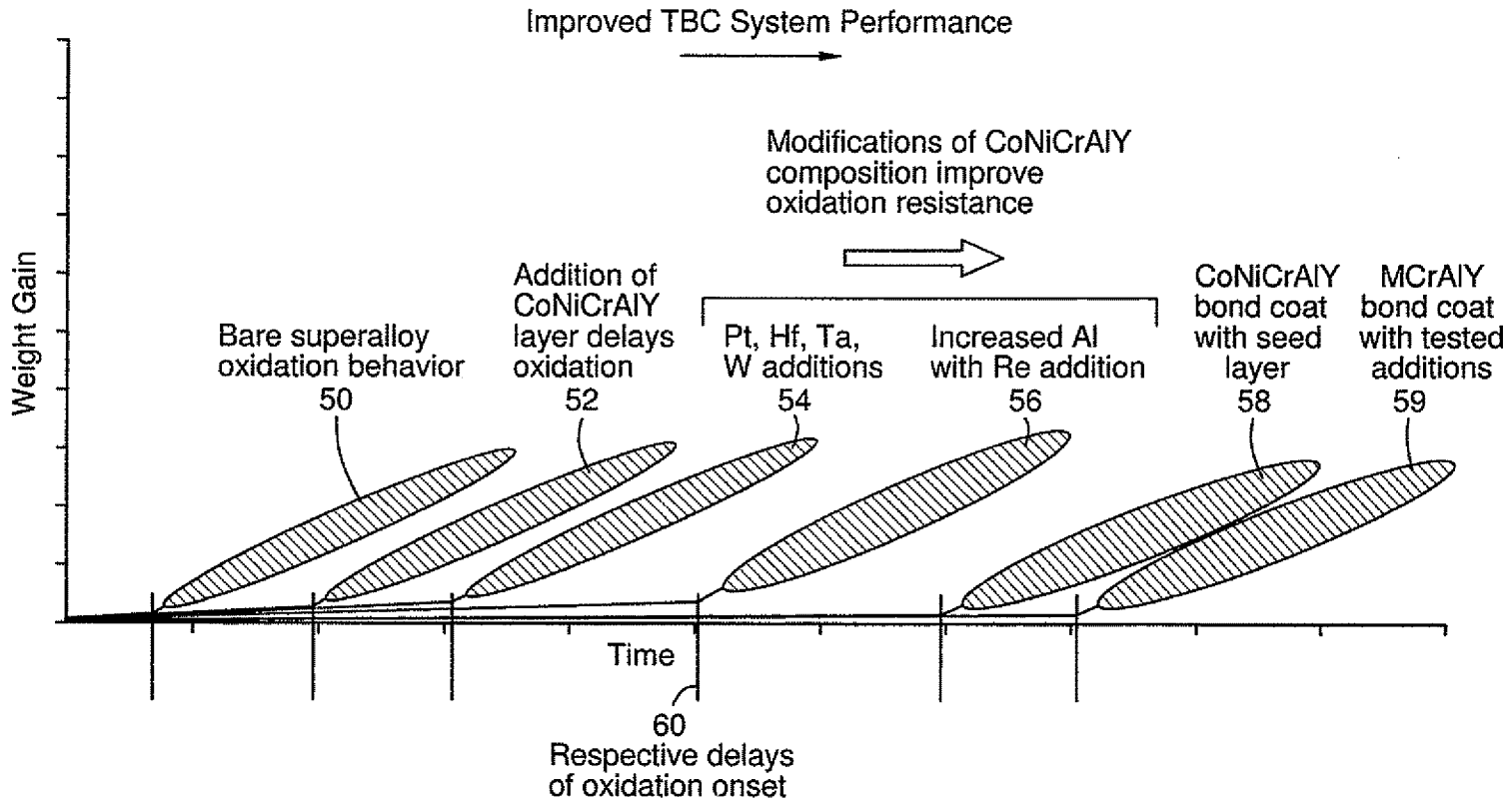
FIG. 5 is a graph of weight gain over time for various protective coatings, illustrating relative oxidation time and durability.

FIG. 5 compares results of prior bond coating options and the present invention, both as a single layer and with two layers, by respective weight gained due to oxidation over time for various protective coatings. A coating life is proportional to the time required for a given weight gain. All of the illustrated samples undergo a change in slope after some passage of time that indicates β-phase depletion. Upon complete beta phase depletion, the oxidation of the system behaves like a bare superalloy; hence the breakaway slope is similar for all systems 50, 52, 54, 56, 58, 59. Since there is no β-phase in superalloys, the weight gain starts earlier with a bare superalloy 50 than with coated systems 52, 54, 56, 58, 59. With an MCrAlY coating 52, first the β depletion occurs in the coating, then after total depletion, the system oxidizes at the same rate as substrate. Modifying the MCrAlY bond coat chemistry 54 with platinum, hafnium, tantalum, and/or tungsten, or modifying it 56 with rhenium, increases its oxidation resistance (total β-phase depletion times). Further improvement is shown with addition 58 of a seed layer under an MCrAlY bond coat as proposed herein. Even better improvement is shown by modifying 59 the bond coat itself with seed layer additions listed herein, making it serve singly as both the bond coat and seed layer.

For example, the bond coat and/or the seed layer(s) may be composed of MCrAlY with 8-12 wt % aluminum and 1-2 wt % rhenium, and the seed layer(s) or the single bond/seed layer may further comprise one or more of the listed seed layer additions.

A seed layer may be 50 to 200 micrometers thick with a preferred range of 75-125 micrometers. Each elemental addition results in a given composition of precipitants and mechanism of performance improvement. The listed combination of 2-5 wt % tantalum and 1-3 wt % lanthanum has a dual mechanism—it both reduces the original beta phase grain size, and produces a Ta-rich secondary beta phase.

Figure 6:
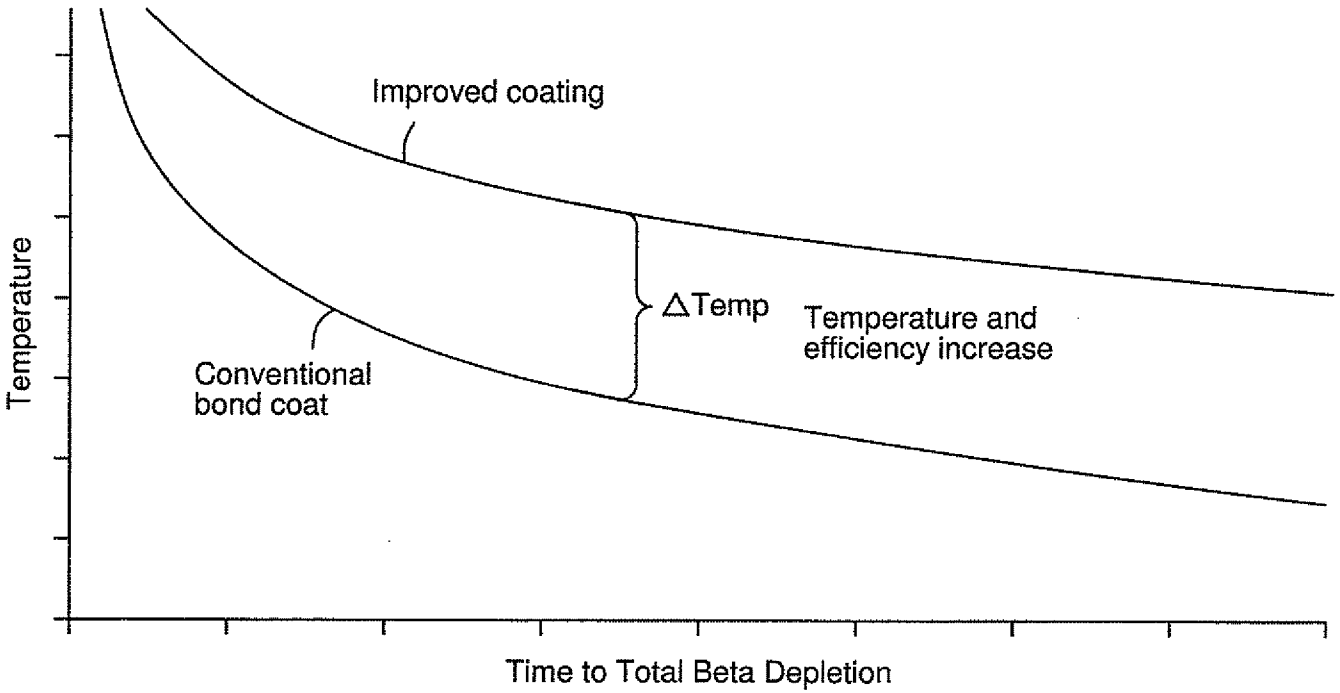
FIG. 6 is a graph of β-phase depletion times per temperature with a conventional bond coat and with an improved coating system according to the invention.

FIG. 6 shows general performance benefits of the present coating system compared to conventional bond coat systems. The improvement is expressed as an increased temperature and/or time at temperature. The present system exceeds the temperature limits of conventional TBC systems, thus substantially improving the performance of gas turbines incorporating such coatings.

The conventional bond coat and/or the modified layer(s) may be deposited by known methods such as air plasma or vacuum plasma/low pressure plasma, wire-arc, flame combustion, high velocity oxy-fuel or a cold spray process, depending on the operational requirements. Also, any known method of forming powders for use in bond coat applications may be used. For example, not to be limiting, a bond coat powder may be prepared by gas atomization of the components to obtain relatively uniform chemistry of the powder particles, which then are deposited or otherwise applied onto a substrate.

Embodiments of the present invention may include components for turbines, such as gas turbine engines, as well as for any other device having a need for a component comprising a thermal barrier system having an advanced bond coat effective to provide increased protection and durability as described herein.

The present invention provides metallic coatings with elemental additions that form secondary and possibly tertiary and quaternary aluminum-rich phase precipitation events. The result of these precipitation events keeps an aluminum reservoir between the oxidizing outer surface of the coating and the substrate rather than allowing the aluminum to diffuse into the substrate base metal, and become unusable for passive oxide growth. This results in superior oxidation resistance and longer life at high temperatures.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A protective metal coating for a nickel-based supperalloy substrate, the protective coating comprising:

a first layer comprising a CoNiCrAlY or a NiCoCrAlY material on a surface of the substrate;

an addition to the first layer material of a seed element in an amount of 1-4 wt % selected from the set consisting of praseodymium (Pr), neodymium (Nd), promethium (Pm), samarium (Sm), europium (Eu), gadolinium (Gd), terbium (Tb), dysprosium (Dy), holmium (Ho), erbium, (Er), thulium (Tm), ytterbium (Yb), lutetium (Lu), and combinations thereof; and a second layer comprising a CoNiCrAlY or a NiCoCrAlY material on a first layer;

whereby the fist layer forms multiphase precipitant aluminum compounds in combination with aluminum diffusing from the second layer material above a given operating temperature, delaying the diffusing aluminum in reaching the substrate, and forming an aluminum reservoir in the first layer that supports aluminum diffusion through the second layer to an outer surface thereof over an extended period of time;

wherein the second layer comprises 8-12 wt % aluminum and further comprises 1-2 wt % rhenium.

2. The protective metal coating of claim 1, wherein the second layer further comprises at least one elemental addition selected from the set consisting of hafnium (Hf), platinum (Pt), titanium (Ti), tungsten (W), and/or tantalum (Ta).

3. A protective coating for a nickel-based superalloy substrate, the protective coating comprising:

a seed layer comprising a CoNiCrAlY or a NiCoCrAlY material on a surface of the substrate; and elemental additions to the seed layer material of 1-4 wt % neodymium and 0.2-1.0 wt % ruthenium;

a second layer comprising a CoNiCrAlY or a NiCoCrAlY material on the seed layer;

whereby the seed layer forms multiphase precipitant aluminum compounds above a given operating temperature, including NiAl3, $NdAl_2$, and RuAl, which delay aluminum diffusion from the second layer material into the substrate.

4. A protective coating for a nickel-based superalloy substrate, the protective coating comprising:

a seed layer comprising a CoNiCrAlY or a NiCoCrAlY material on a surface of the substrate, and elemental additions to the seed layer material of 2-5 wt % tantalum and 1-3 wt % lanthanum;

whereby the seed layer forms $TaAl_3$ above a given operating temperature, which delays aluminum diffusion from the seed layer material into the substrate.

5. The protective coating of claim 4, further comprising a ceramic thermal barrier coating on the seed layer.

* * * * *